US009822526B2

(12) United States Patent
Cook et al.

(10) Patent No.: US 9,822,526 B2
(45) Date of Patent: Nov. 21, 2017

(54) GENERAL PURPOSE INSULATION BAG

(71) Applicant: Owens Corning Intellectual Capital, LLC, Toledo, OH (US)

(72) Inventors: David M. Cook, Granville, OH (US); Julie Pope, Monroe, MI (US); Paul B. Machacek, Wheaton, IL (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 14/828,992

(22) Filed: Aug. 18, 2015

(65) Prior Publication Data

US 2016/0052696 A1 Feb. 25, 2016

Related U.S. Application Data

(60) Provisional application No. 62/040,462, filed on Aug. 22, 2014.

(51) Int. Cl.

| | |
|---|---|
| ***E04B 1/76*** | (2006.01) |
| ***E04D 13/17*** | (2006.01) |
| ***E04B 1/78*** | (2006.01) |

(52) U.S. Cl.

CPC ..... *E04B 1/7604* (2013.01); *E04B 1/7658* (2013.01); *E04B 1/78* (2013.01); *E04D 13/17* (2013.01)

(58) Field of Classification Search

CPC ..... E04B 1/7604; E04B 1/78; E04B 1/7658; E04D 13/17

See application file for complete search history.

(56) References Cited

U.S. PATENT DOCUMENTS

| | | | | |
|---|---|---|---|---|
| 2,700,633 | A | 1/1955 | Bovenkerk | |
| 3,003,902 | A | 10/1961 | McDuff | |
| 4,172,345 | A | 10/1979 | Alderman | |
| 4,318,427 | A | 3/1982 | Cross, Jr. | |
| 4,399,645 | A | 8/1983 | Murphy et al. | |
| 4,675,225 | A | 6/1987 | Cutler | |
| 4,988,406 | A | 1/1991 | Nelson | |
| 5,379,568 | A | 1/1995 | Murray | |
| 5,475,955 | A * | 12/1995 | Dickinson | E04F 11/064 182/46 |
| 5,628,151 | A | 5/1997 | Monat | |
| 5,792,540 | A | 8/1998 | Hughes | |
| 5,848,509 | A | 12/1998 | Knapp et al. | |

(Continued)

FOREIGN PATENT DOCUMENTS

| | | | | |
|---|---|---|---|---|
| GB | 2430947 A * | 4/2007 | | E04D 13/178 |
| WO | WO 9216785 A1 * | 10/1992 | | E04B 1/7604 |
| WO | WO 2016004957 A1 * | 1/2016 | | E04B 1/76 |

*Primary Examiner* — Rodney Mintz

(74) *Attorney, Agent, or Firm* — MacMillan, Sobanski & Todd, LLC

(57) ABSTRACT

A general purpose insulation bag is provided. The general purpose insulation bag includes a jacket configured to form a desired three dimensional shape. The jacket forms a cavity therewithin and has an opening. Insulative material is positioned within the cavity and is configured to form an insulative layer. The insulative layer has a thickness configured to provide a desired insulative value to the general purpose insulation bag. The opening is configured to retain the insulative material within the cavity formed within the jacket.

16 Claims, 4 Drawing Sheets

(56) References Cited

U.S. PATENT DOCUMENTS 6,156,086 A * 12/2000 Zhang ..... A47L 9/14 428/36.1
6,223,490 B1 * 5/2001 Wessley ..... E04B 9/003 49/463
6,442,903 B1 9/2002 Hebert
6,878,427 B2 4/2005 Schmidt et al.
7,263,810 B1 * 9/2007 Trauba ..... E04B 1/7604 52/404.1
7,770,353 B2 8/2010 Olsen
8,397,434 B2 3/2013 Bayne
8,438,789 B2 5/2013 Uhl et al.
8,590,229 B2 11/2013 Taylor et al.
8,595,986 B2 12/2013 Uhl et al.
8,931,215 B1 * 1/2015 Cook ..... E04B 9/001 182/46
9,222,265 B2 * 12/2015 Richmond ..... E04F 11/062
2004/0163345 A1 8/2004 Alderman
2005/0095936 A1 * 5/2005 Jones ..... A47C 31/001 442/136
2006/0191058 A1 * 8/2006 Huza ..... A41B 9/00 2/239
2007/0227530 A1 * 10/2007 Bayne ..... A01G 9/241 126/621
2008/0087557 A1 * 4/2008 Evans ..... B65D 75/5827 206/83.5
2008/0121836 A1 * 5/2008 Bowman ..... E04B 1/7604 252/62
2009/0019802 A1 * 1/2009 Crall, Jr. ..... F16L 59/121 52/404.3
2009/0061147 A1 * 3/2009 Lippy ..... B29D 22/02 428/76
2009/0314672 A1 * 12/2009 Evans ..... B65D 75/5827 206/321
2010/0058672 A1 * 3/2010 Bayne ..... A01G 9/241 52/2.11
2012/0304860 A1 * 12/2012 Matson ..... B01D 46/02 95/273
2012/0328807 A1 12/2012 Grimes
2013/0094791 A1 * 4/2013 Aspenson ..... E04B 1/7604 383/211
2013/0232880 A1 9/2013 Cook et al.
2013/0327705 A1 * 12/2013 Clark ..... G10K 11/168 210/508
2015/0101272 A1 * 4/2015 Richmond ..... E04F 11/062 52/183

* cited by examiner

GENERAL PURPOSE INSULATION BAG

RELATED APPLICATIONS

This application claims the benefit of U.S. Provisional Application No. 62/040,462, filed Aug. 22, 2014, the disclosure of which is incorporated herein by reference in its entirety.

BACKGROUND

Commercial, residential and industrial buildings, such as for example, offices, homes, apartments and hospitals are formed from various structures that define interior spaces within the building. Non-limiting examples of the various structures include walls, windows, floors, crawl spaces and roofs. In addition to defining the building's interior spaces, the various structures can separate air located within the building's interior spaces from air located external to the building.

In certain instances, the internal air may be conditioned for desired characteristics, such as for example, temperature and humidity qualities. In these instances, the energy efficiency of the buildings can be affected by insulating the various structures separating the internal air from the external air.

Another structure commonly formed within buildings is an opening in an attic floor. The opening can be configured to provide access from a lower level of the building to an upper level, such as an attic. The opening in the attic floor is commonly known as a scuttle. While devices and structures are known to insulate scuttles, in certain instances insulating the scuttle to provide a desired thermal insulative value (R-value) can be difficult.

In addition to scuttles, other spaces within the buildings can be formed by the various building structures, such as for example, interior spaces positioned adjacent rim joists or interior spaces positioned adjacent roof rafters. In certain instances, these spaces can be difficult to access. In other instances, the spaces can be difficult to insulate due to the shape of the space.

It would be advantageous if attic scuttles and other interior spaces could be insulated more effectively.

SUMMARY

In accordance with embodiments of this invention there is provided a general purpose insulation bag. The general purpose insulation bag includes a jacket configured to form a desired three dimensional shape. The jacket forms a cavity therewithin and has an opening. Insulative material is positioned within the cavity and is configured to form an insulative layer. The insulative layer has a thickness configured to provide a desired insulative value to the general purpose insulation bag. The opening is configured to retain the insulative material within the cavity formed within the jacket.

In accordance with other embodiments, there is also provided an insulated interior building cavity. The insulated interior building cavity includes an interior building cavity formed between framing members. One or more general purpose insulation bags is positioned in the interior building cavity and configured to insulate the interior building cavity. The one or more general purpose insulation bags includes a jacket configured to form a desired three dimensional shape. The jacket forms a cavity therewithin and has an opening. Insulative material is positioned within the cavity and is configured to form an insulative layer. The insulative layer has a thickness configured to provide a desired insulative value to the general purpose insulation bag. The opening is configured to retain the insulative material within the cavity formed within the jacket.

In accordance with other embodiments, there is also provided a method of insulating an interior building cavity. The method includes the steps of positioning one or more general purpose insulation bags in the interior building cavity. The one or more general purpose insulation bags including a jacket configured to than a desired three dimensional shape. The jacket forming a cavity therewithin and having an opening. Insulative material is positioned within the cavity and configured to form an insulative layer. The insulative layer has a thickness configured to provide a desired insulative value to the general purpose insulation bag. The opening is configured to retain the insulative material within the cavity formed within the jacket.

Various advantages of the general purpose insulation bag will become apparent to those skilled in the art from the following detailed description of the invention, when read in light of the accompanying drawings.

DETAILED DESCRIPTION

Figure 1:
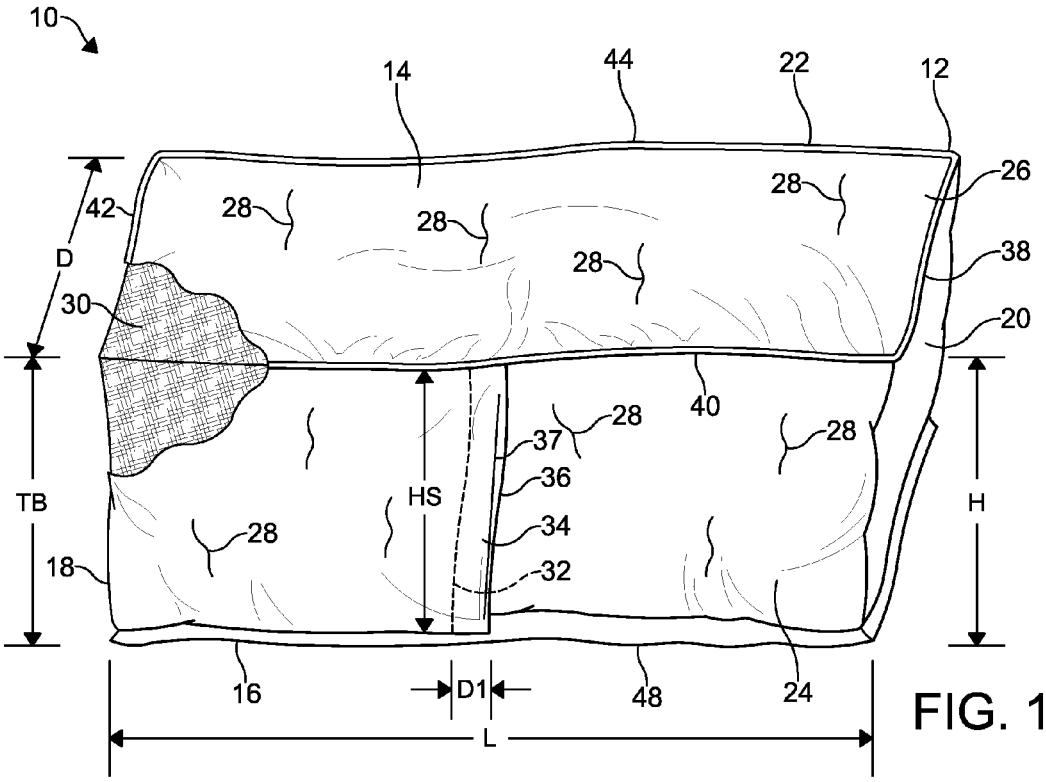
FIG. 1 is a perspective view, of a first embodiment of a general purpose insulation bag.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the tem' "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, a general purpose insulation bag is provided. The term "building", as used herein, is defined to mean any commercial, residential or industrial structure. The term "building structure", as used herein, is defined to mean any assembly, subassembly, system or subsystem constructed as part or portion of a building. The term "scuttle", as used herein, is defined to mean an opening configured to provide access from one level of a building to another level of the building. The term "attic", as used herein, is defined to mean an open space at an upper level of a building, just below the roof.

The description and figures disclose a general purpose insulation bag and methods of using the general purpose insulation bag (hereafter "insulation bag"). The insulation bag is configured to prevent or substantially retard the flow of air passing from interior spaces of a building to exterior spaces of a building or from exterior spaces of a building to interior spaces of a building. In certain instances, the flow of air can pass through openings between building levels, such as for example, an attic scuttle. In other instances, the flow of air can pass through or between interior spaces formed by building structures, such as the non-limiting examples of interior spaces positioned adjacent rim joists or interior spaces positioned adjacent roof rafters. Generally, the insulation bag includes a flexible jacket filled with insulative material. The insulation bag is configured for positioning within the interior spaces to be insulated. While the insulation bag will initially be described as being configured for positioning within the structural framing members forming the attic scuttle, subsequent embodiments will illustrate use of the insulation bag in other insulative applications.

Referring now to FIG. 1, a first embodiment of an insulation bag is illustrated at 10. The insulation bag 10 includes a jacket 12. The jacket 12 is configured as an enclosure of insulative materials and has cooperating panels, as will be discussed in more detail below. The jacket 12 is configured for flexibility, such that the jacket 12 can have a contracted or unfilled arrangement, a partially-filled arrangement or an expanded or filled arrangement. In the contracted or unfilled arrangement, the jacket 12 is devoid of any insulative materials contained therewithin. In the partially-filled arrangement, the jacket 12 can be filled with a volume of insulative materials that is less than a jacket 12 that is fully filled with insulative materials. In the expanded or filled arrangements, the jacket 12 is substantially filled with insulative materials. As will be discussed further below, in a partially-filled arrangement or in an expanded or filled arrangement, the jacket 12 can assume one or more desired shapes.

Referring again to FIG. 1, the jacket 12 can be formed from one or more materials. In the illustrated embodiment, the jacket 12 is formed from a spunbond polymeric material, such as for example polypropylene. However, in other embodiments, other polymeric materials, such as for example polyethylene terephthalate or other combinations of materials can be used. In still other embodiments, the jacket 12 can also be formed as a fibrous web of non-woven fibers, such as for example, fiberglass fibers.

Referring again to FIG. 1, the material forming the jacket 12 provides desired characteristics for puncture resistance and tear resistance as defined by a tensile strength in a machine direction, a tensile strength in a cross machine direction, an elongation in a machine direction and an elongation in a cross machine direction. In the illustrated embodiment, the material forming the jacket 12 provides a tensile strength in a machine direction in a range of from about 150.0 N/50 mm (33.72 lbs./2.0 inches) to about 170.0 N/50 mm (38.22 lbs./2.0 inches) as measured by test standard ERT 20.2-89, a tensile strength in a cross machine direction in a range of from about 100.0 N/50 mm (22.48 lbs./2.0 inches) to about 130.0 N/50 mm (29.23 lbs./2.0 inches) as measured by test standard ERT 20.2-89, an elongation in a machine direction in a range of from about 100.0% to about 110.0% as measured by test standard ERT 20.2-89 and an elongation in a cross machine direction in a range of from about 100.0% to about 110.0% as measured by test standard ERT 20.2-89. However, it should be appreciated that in other embodiments the tensile strength in a machine direction can be less than about 150.0 N/50 mm (33.72 lbs./2.0 inches) or more than about 170.0 N/50 mm (38.22 lbs./2.0 inches) as measured by test standard ERT 20.2-89, the tensile strength in a cross machine direction can be less than about 100.0 N/50 mm (22.48 lbs./2.0 inches) or more than about 130.0 N/50 mm (29.23 lbs./2.0 inches) as measured by test standard ERT 20.2-89, the elongation in a machine direction can be less than about 100.0% or more than about 110.0% as measured by test standard ERT 20.2-89 and the elongation in a cross machine direction can be less than about 100.0% or more than about 110.0% as measured by test standard ERT 20.2-89, sufficient that the material forming the jacket 12 provides desired characteristics for puncture resistance and tear resistance.

In the illustrated embodiment, the material forming the jacket 12 has a thickness that results in a weight of about 2.0 ounces per square foot to about 3.0 ounces per square foot. However, in other embodiments, the thickness of the material forming the jacket 12 can result in a weight of less than about 2.0 ounces per square foot or greater than about 3.0 ounces per square foot, sufficient that the jacket 12 is flexible and can substantially resist punctures and tears.

Referring again to FIG. 1, the jacket 12 includes an upper panel 14, a lower panel 16, opposing end panels 18, 20 and opposing side panels 22, 24. The panels 14, 16, 18, 20, 22 and 24 cooperated to form an enclosed cavity 26 therewithin.

Referring again to FIG. 1, in certain embodiments the jacket 12 can include a plurality of perforations or apertures 28. The perforations 28 are configured to allow the jacket 12 to "breathe" (also referred to as "air permeability"). The terms "breathe" or "air permeability", as used herein, is defined to mean the jacket 12 can allow a desired quantity of air to pass through the jacket 12 while retaining the insulation material within the jacket 12. The quantity, size, spacing, shape and arrangement of the perforations 28 are considerations in determining the air permeability of the jacket 12. The perforations 28 can have any desired size, spacing, shape and arrangement sufficient to affect the desired air permeability of the jacket 12.

In the illustrated embodiment, the material forming the jacket 12 has an air permeability in a range of from about 100 cubic feet per minute per square foot to about 140 cubic feet per minute per square foot as measured by test standard ASTM D737-96. However, in other embodiments, the material forming the jacket 12 can have an air permeability less than about 100 cubic feet per minute per square foot or more than about 140 cubic feet per minute per square foot, sufficient to allow a desired quantity of air to pass through the jacket 12 while retaining the insulation material within the jacket 12.

Referring again to FIG. 1, in a partially-filled or a substantially filled arrangement, the jacket 12 envelops insulative material 30 positioned within the cavity 26. In the illustrated embodiment, the insulative material 30 is a loose-fill insulative material. The term "loosefill", as used herein, is defined to mean any insulative material formed from a multiplicity of discrete, individual tuffs, cubes, flakes, or nodules. The insulative material 30 can be made of glass fibers or other mineral fibers, and can also be polymeric fibers, organic fibers or cellulose fibers. The insulative material 30 can have a binder material applied to it, or it can be binderless. While the jacket 12 illustrated in FIG. 1 has been described as enveloping the loosefill insulative material 30, it should be appreciated other forms and types of insulative materials can be used, including the non-limiting examples of portions of insulative batts, ground insulative batts and ground insulative foamular boards.

Referring again to FIG. 1, the jacket 12 includes a slit 32 formed in side panel 24 and a covering structure 34. The slit 32 can have an open arrangement and a closed arrangement. In an open arrangement, the slit 32 is configured to form an aperture in the side panel 24, thereby facilitating insertion of insulative materials 30 into the cavity 26 formed within the jacket 12. In a closed arrangement, the slit 32, in combination with the covering structure 34, is configured to substantially prevent insulative material 30 from exiting the slit 32. In the illustrated embodiment, the slit 32 extends vertically in the side panel 24 and has a height HS that approximates a height of the side panel 24. The dimensions of the insulation bag 10 will be discussed in more detail below. In other embodiments, the slit 32 can be formed in other locations of the insulation bag 10, such as the non-limiting examples of the panels 14, 16, 18, 20 or 22. In other embodiments, the slit 32 can have non-vertical orientations and the slit 32 can have any desired length sufficient to facilitate insertion of insulative materials 30 into the cavity 26 formed within the jacket 12. In still other embodiments, the slit 32 can be formed with other structures, such as the non-limiting example of a horizontally oriented slit, sufficient to facilitate insertion of insulative materials 30 into the cavity 26 formed within the jacket 12.

Referring again to FIG. 1, the covering structure 34 is configured to cover the slit 32 after the insulative materials 30 are inserted into the cavity 26 formed within the jacket 12. The covering structure 34, in combination with the slit 32 in a closed arrangement, is further configured to substantially prevent insulative material 30 from exiting the slit 32. In the embodiment illustrated in FIG. 1, the covering structure 34 is a flap. However, in other embodiments, the covering structure 34 can be formed from other structures, mechanisms and devices, such as for example lids, caps, zippers and ports, sufficient to substantially prevent insulative material 30 from exiting the slit 32 after insulative materials 30 are inserted into the cavity 26 famed within the jacket 12.

Referring again to FIG. 1, the covering structure 34 has a leading edge 36. In the illustrated embodiment, the leading edge 36 has a substantially parallel orientation with the slit 32. However, it should be appreciated that in other embodiments, the leading edge 36 need not be parallel with the slit 32. The leading edge 36 extends from the slit 32 a distance D1. The distance D1 is configured to substantially prevent insulative material 30 from exiting the slit 32 after insulative materials 30 are inserted into the cavity 26 formed within the jacket 12. In the illustrated embodiment, the distance D1 is in a range of from about 6.0 inches to about 10.0 inches. Alternatively, the distance D1 can be less than about 6.0 inches or more than about 10.0 inches, sufficient to substantially prevent insulative material 30 from exiting the slit 32 after insulative materials 30 are inserted into the cavity 26 formed within the jacket 12.

Referring again to FIG. 1, optionally the leading edge 36 of the covering structure 34 can be fastened to the side panel 24 by a fastening structure 37. The fastening structure 37 is configured to maintain the covering structure 34 in a closed position adjacent the side panel 24. Non-limiting examples of suitable fastening structures 37 include hook and loop structures, buttons, snaps and zippers.

Referring again to FIG. 1, a seam 38 is formed at the intersection of the upper panel 14 and the end panel 20. Similarly, seams 40, 42 and 44 are formed between the upper panel 14 and the panels 24, 18 and 22 and seams 48, 46 are formed between the lower panel 16 and the panels 24, 20. While not illustrated in FIG. 1, it should be appreciated that similar seams are formed between the lower panel 16 and the end panel 18 and between the lower panel 16 and the side panel 22. The seams 38, 40, 42, 44, 46 and 48 are configured to provide rigidity to the insulation bag 10 and are further configured to define a general shape to the insulation bag 10. In the illustrated embodiment, the seams 38, 40, 42, 44, 46 and 48 result in the insulation bag 10 having a generally three dimensional rectangular shape. However, as will be discussed in more detail below, the insulation bag 10 can have other desired three dimensional shapes.

Referring again to FIG. 1, the seams 38, 40, 42, 44, 46 and 48 are formed by sewing the respective panels together at the intersections of the panels 14, 16, 18, 20, 22 and 24. Alternatively, the seams 38, 40, 42, 44, 46 and 48 can be formed by other desired processes, including the non-limiting examples of adhesives, thermal bonding and hook and loop fasteners.

Referring again to FIG. 1, the insulation bag 10 has a length L, a height H and a depth D. The dimensions L, H, and D result in the insulation bag 10 being configured for positioning within structural framing members forming an attic scuttle. In the illustrated embodiment, the length L is in a range of from about 30.0 inches to about 40.0 inches, the height H is in a range of from about 12.0 inches to about 18.0 inches and the depth D is in a range of from about 20.0 inches to about 28.0 inches. In other embodiments, the length L can be less than about 30.0 inches or more than about 40.0 inches, the height H can be less than about 12.0 or more than about 18.0 inches and the depth D can be less than about 20.0 inches or more than about 28.0 inches, sufficient that the insulation bag 10 can be positioned within structural framing members forming an attic scuttle.

Referring again to FIG. 1, the insulation bag 10 is configured to provide an insulative value (R-value) to a building scuttle. The insulative value of the insulation bag 10 is determined, in part, by the density of the insulative material 30 and the thickness TB of the insulative material 30 within the jacket 12. In the illustrated embodiment, the insulative material 30 has a density in a range from about 0.2 lbs/ft$^3$ (3.2 kg/m$^3$) to about 5.0 lbs/ft$^3$ (80.1 kg/m$^3$) and a thickness TB in a range of from about 1.0 inches (2.54 cm) to about 18.0 inches (25.4 cm). The combination of density and thickness of the insulative material 30 results in an insulative value (R-value) of the insulation bag 10 in a range of from about R-11 to about R-60. In other embodiments, the insulation bag 10 can have insulative values less than about R-11 or more than R-60 as a result of combinations of densities less than about 0.2 lbs/ft$^3$ (3.2 kg/m$^3$) or more than about 5.0 lbs/ft$^3$ (80.1 kg/m$^3$) and thicknesses TB less than about 1.0 inches (2.54 cm) or more than about 18.0 inches (25.4 cm). As one non-limiting example of an alternate insulative value (R-value) of the insulation bag 10, the insulative material 30 can have a density yielding an R-value of 4.0 per inch. Accordingly, a thickness TB of the insulative material 30 within the jacket 12 of 40.0 inches would yield an insulative value (R-value) of 160.0.

Advantageously, the insulation bag 10 is configured to provide a high R-value level, which can be as high as R-60 or more. In certain embodiments, the R-value of the insulation bag 10 can be equal to or more than the R-value of the insulative material (not shown) positioned within the attic and surrounding insulative bag.

Figure 2:
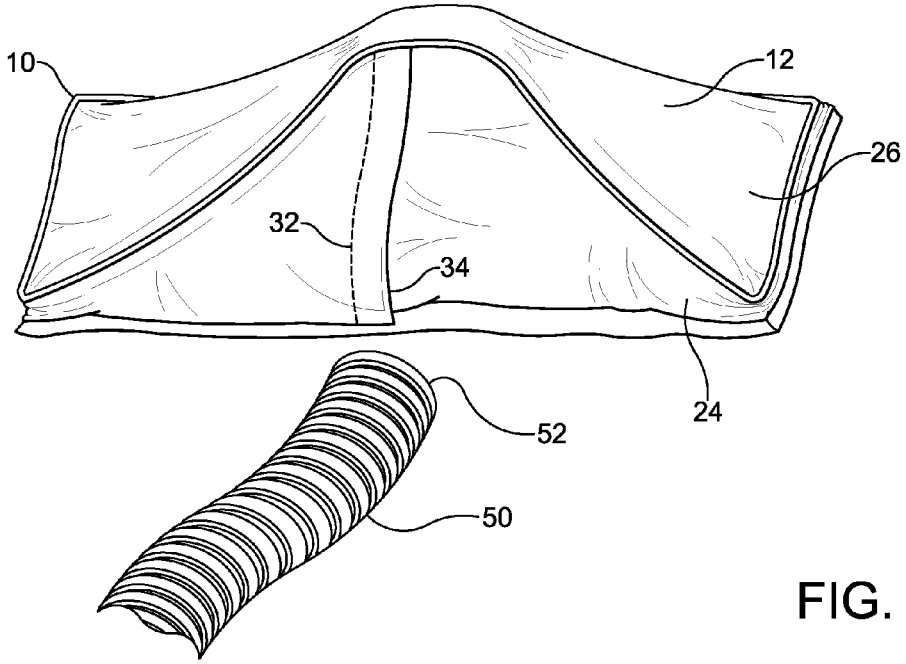
FIG. 2 is a perspective view of the general purpose insulation bag of FIG. 1, shown in a contracted or unfilled arrangement.
Figure 3:
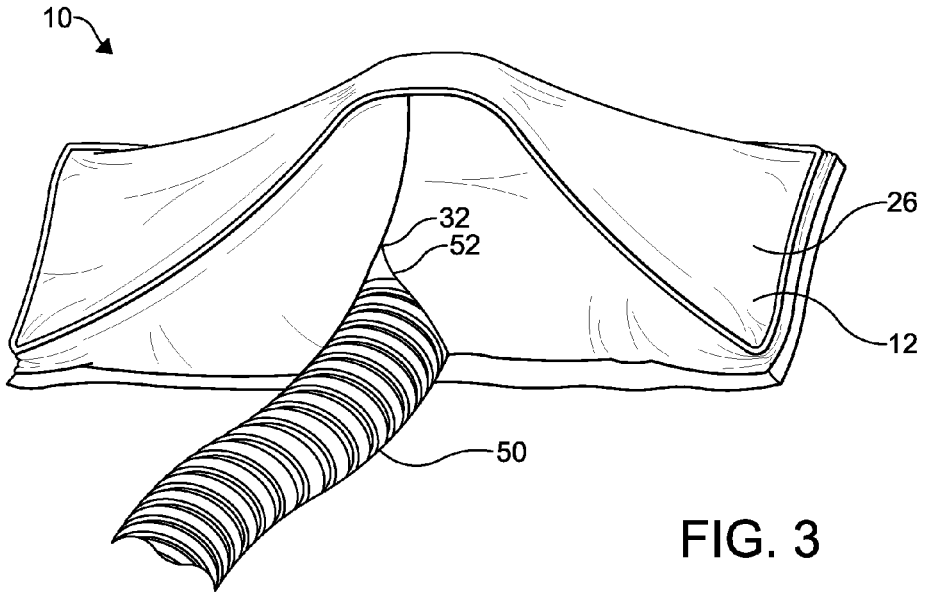
FIG. 3 is a perspective view of the general purpose insulation bag of FIG. 2, shown with a distribution hose from a blowing insulation machine inserted into a cavity formed within the bag.
Figure 4:
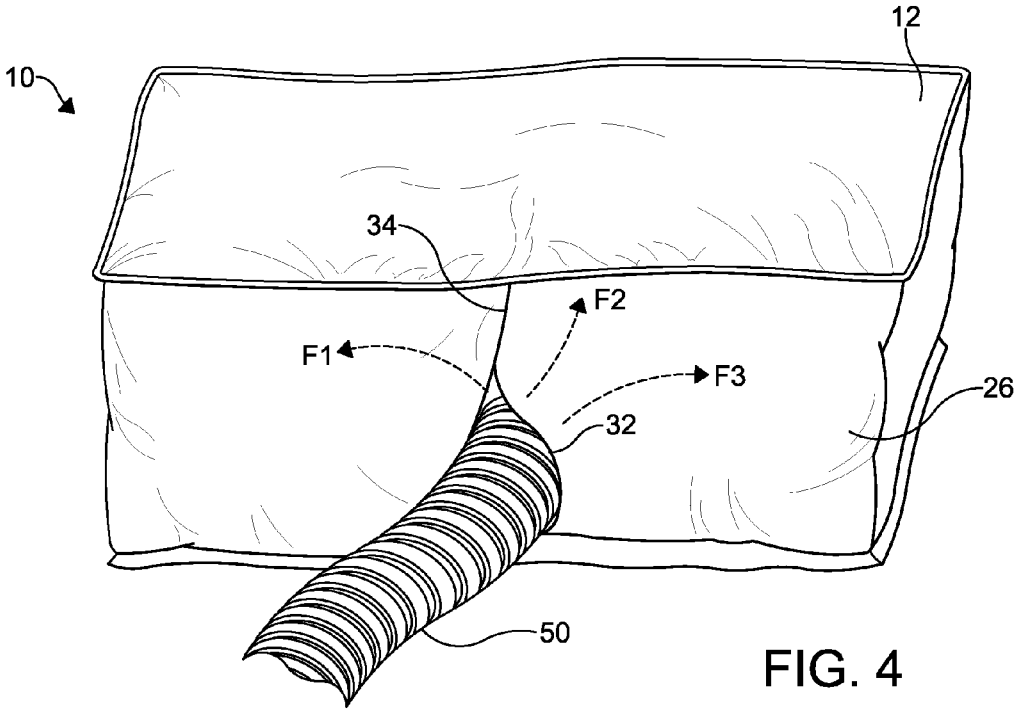
FIG. 4 is a perspective view of the general purpose insulation bag of FIG. 3, shown with the cavity formed within the bag partially or substantially filled with insulative material.

Referring now to FIGS. 2-4, a method of filling the insulation bag 10 with insulative materials is illustrated. Referring first to FIG. 2, the insulation bag 10 is shown in the jacket 12 in a contracted or unfilled arrangement. That is, the cavity 26 formed within the jacket 12 is devoid of any insulation materials. In a first step, the side panel 24 is positioned such that access of the slit 32 can be gained through the covering structure 34. A hose 50 originating with a blowing insulation machine (not shown) is shown adjacent the unfilled insulation bag 10. The hose 50 is configured to distribute conditioned insulative materials (not shown) entrained in an airstream by the blowing insulation machine. The hose 50 has an outlet end 52 from which the conditioned insulative material exits the hose 50. Any desired hose 50 and any desired blowing insulation machine can be used.

Referring now to FIG. 3 in a next step, the outlet end 52 of the distribution hose 50 is inserted through the slit 32 and positioned in the cavity 26 within the jacket 12.

Referring now to FIG. 4 in a next step, the cavity 26 within the jacket 12 receives forced air entrained with insulative material (represented by direction arrows F1-F3) through the distribution hose 50. The insulation bag 10 is filled with the insulative material until a desired depth of the insulative material is formed. The hose 50 is subsequently removed from the slit 32 and the covering structure 34 is positioned to cover the slit 32. The insulation bag 10 is now partially filled or substantially filled with insulative material and ready for use. It is within the contemplation of the insulation bag 10 that the jacket 12 can be filled with insulative material in other desired manners, including the non-limiting example of pouring the insulative material into the slit 32 of the jacket 12.

Figure 5:
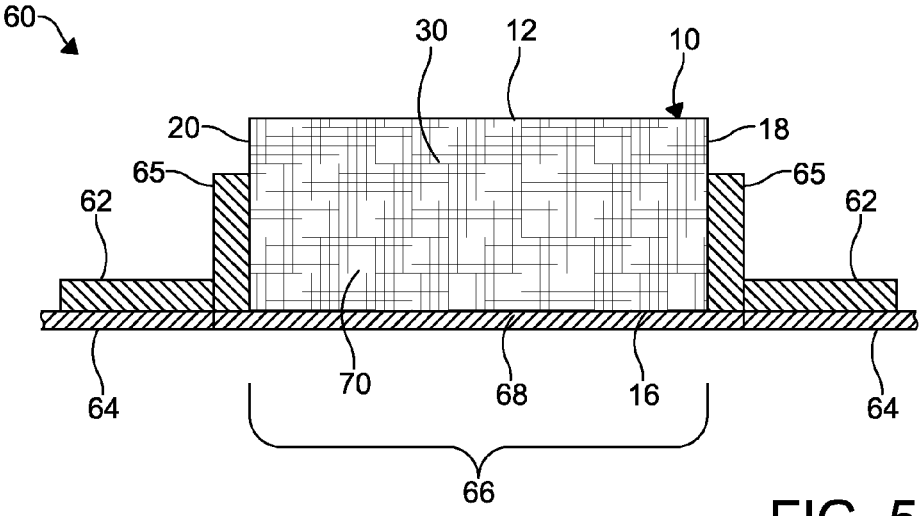
FIG. 5 is a side view, in elevation, of the general purpose insulation bag of FIG. 4 installed in a building scuttle.

Referring now to FIG. 5, a building scuttle 60 equipped with an insulation bag 10 is illustrated. The insulation bag 10 is filled with insulative material 30 enclosed by the jacket 12. The building scuttle 60 is positioned among horizontally oriented ceiling joists 62 and ceiling materials 64 attached to the ceiling joists 62. In the illustrated embodiment, the ceiling joists 62 are framing members made from wood. However, in other embodiments, the ceiling joists 62 can be other desired framing members, including the non-limiting examples of steel studs or wood lathe. In the illustrated embodiment, the ceiling materials 64 are drywall panels. Alternatively, the ceiling materials 64 can be other materials including the non-limiting examples of plaster, tiles or panels.

Referring again to FIG. 5, a plurality of framing members 65 are arranged in a manner such as to define a scuttle 66. In the illustrated embodiment, the framing members 65 are made from wood. However, in other embodiments, the framing members 65 can be formed from other desired materials, including the non-limiting examples of steel studs or wood lathe. The scuttle 66 can have any desired height, width and length dimensions. Ceiling materials 68 can be attached to the framing members 65. The ceiling materials 68 and the framing members 65 cooperate to form a scuttle cavity 70.

Referring again to FIG. 5, in operation the insulation bag 10, filled with insulative materials 30, is positioned in the scuttle cavity 70 such that the lower panel 16 seats against the ceiling material 68 and the side panels 18, 20 form a friction or interference fit with the framing members 65. The terms friction or interference fit, as used herein, is defined to mean a fastening between the insulation bag 10 and the framing members 65 that is achieved by friction after the insulation bag 10 is inserted into the scuttle cavity 70, rather than by any other means of fastening. In certain embodiments, in the installed position, side panels 18, 20 of the insulation bag 10 and the insulation material 30 can extend in a vertical direction above the top surfaces of the framing members 65, although such is not necessary for the operation of the insulation bag 10.

Figure 6:
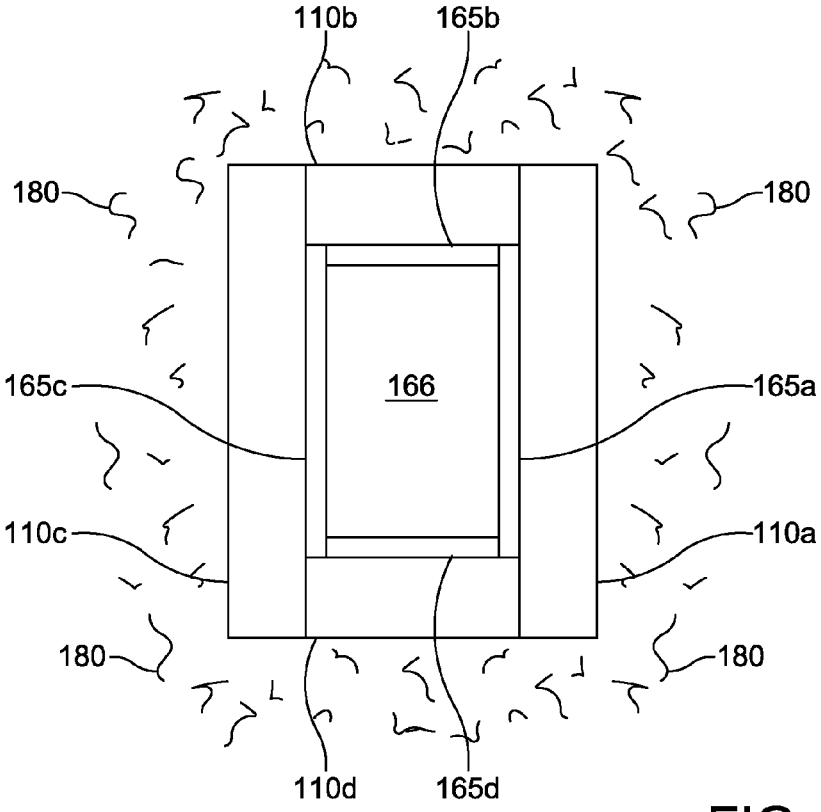
FIG. 6 is a plan view of a plurality of general purpose insulation bags of FIG. 4 used to form a fence around a building scuttle.

While the insulation bag 10 has been shown in FIG. 5 and described above as being positioned within the framing members 65 forming an attic scuttle 60, it is within the contemplation of the insulation bag 10 that the insulation bag 10 can be used in other insulating instances. Referring now to FIG. 6, another use of the insulation bags 10 is illustrated. Generally, in this non-limiting instance, a plurality of insulation bags 110*l*-110*d* are used to surround framing members forming an attic scuttle, thereby forming an insulated fence. The insulated fence is configured to form a barrier, thereby separating the attic scuttle from other attic insulation material. As shown in FIG. 6, an attic scuttle 166 is formed by framing members 165*a*-165*d*. Insulation bags 110*a*-110*d* are seated against the framing members 165*a*-165*d* such as to form an insulative fence. The insulative fence is configured to maintain separation between attic insulative material, shown schematically at 180, and the attic scuttle 166. The insulation bags 110*a*-110*d* can be filled with any desired quantity of insulative material (not shown). The attic insulative material 180 can have any form, such as for example, loosefill insulation material, insulative batts or any combination thereof. In certain instances, the insulation bags 110*a*-110*d* can be placed over attic insulation material 180, adjacent the framing members 165*a*-165*d* and in other instances, the insulation bags 110*a*-110*d* can be placed atop horizontally oriented ceiling joists (not shown). As discussed above, R-value of the insulation bags 110*a*-110*d* can be at least equivalent to or more than the R-value of the attic insulation material 180 surrounding the attic scuttle 166.

Figure 7:
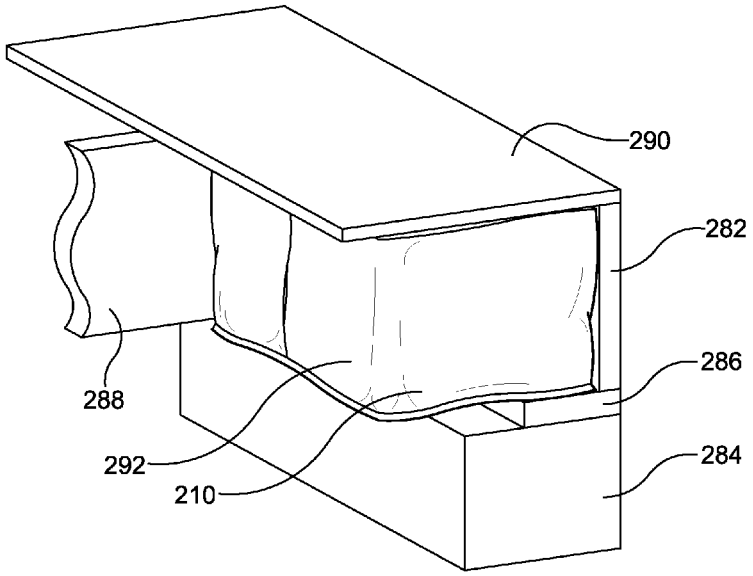
FIG. 7 is a perspective view of the general purpose insulation bag of FIG. 4 used to insulate interior spaces formed adjacent rim joists.

Referring now to FIG. 7, another embodiment of an insulation bag is illustrated generally at 210. In this embodiment, the insulation bag 210 is configured to insulate interior building spaces formed adjacent rim joints 282, when used as framing members for building, residential or industrial construction. In this embodiment, a building foundation 284 supports a plurality of rim joists 282 (a lone rim joist is shown in FIG. 7 for purposes of clarity) with a plurality of sill plates 286 positioned therebetween. A plurality of floor joists 288 extend inwardly from the rim joists 282 (for purposes of clarity, only a lone floor joist 288 is illustrated). The floor joists 288 support sub-flooring sheets 290. As shown in FIG. 7, interior building cavities 292 are formed between the foundation 284, sill plate 286, rim joist 282, floor joist 288 and sub-flooring sheets 290. It is understood that the rim joists 282 and the interior building cavities 292 can extend around the perimeter of the building. As shown in FIG. 7, the insulation bag 210 is configured for placement in the interior cavities 292 adjacent the rim joist 282. The insulation bag 210 can include insulative materials (not shown) enclosed in a jacket as discussed above. In this position, the insulation bag 210 is configured to insulate the interior building spaces 292 formed adjacent to the rim joist 282.

Figure 8:
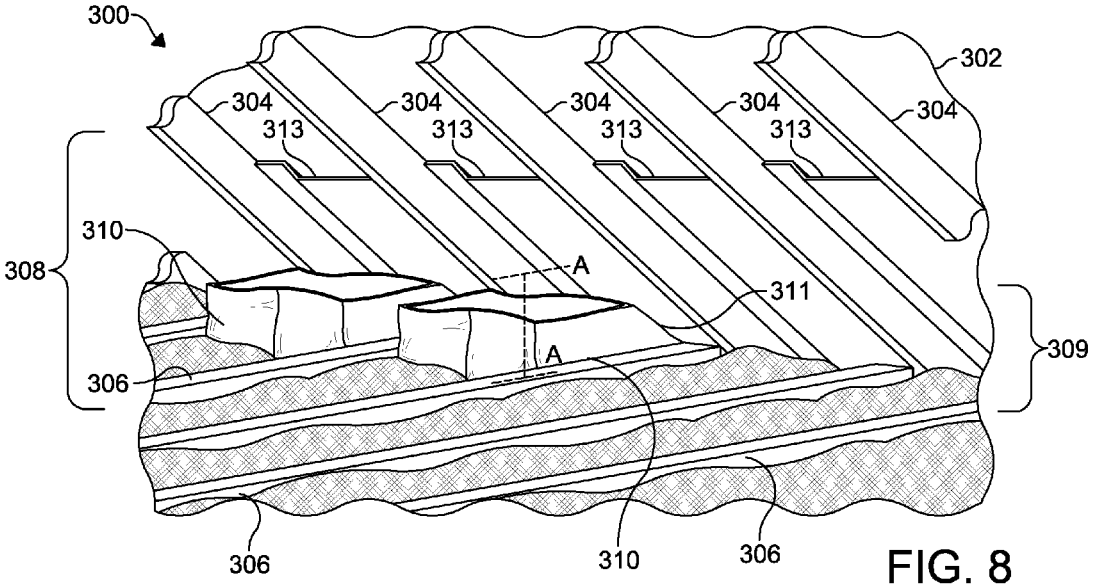
FIG. 8 is a perspective view of an alternate embodiment of a general purpose insulation bag used to insulate interior attic spaces formed adjacent roof rafters and ceiling joists.

While the embodiments of the insulation bag discussed above and shown in FIGS. 1-7 illustrate the insulation bag as having a generally three dimensional rectangular shape, it should be appreciated that the insulation bag can have other three dimensional shapes. Referring now to FIG. 8, another embodiment of an insulation bag is illustrated generally at 310. A portion of a building is illustrated generally at 300. The building 300 includes a roof deck 302, supported by a plurality of rafters 304 and an internal ceiling (not shown) supported by a plurality of framing members 306. An attic space 308 is formed internal to the building 300 and defined, in part, by the roof deck 302 and the framing members 306. Insulation cavities 309 are defined in a generally horizontal direction as between the framing members 306 and in a generally vertical direction as between the rafters 304. As shown in FIG. 8, an insulation cavity 309 can be filled with an insulation bag 310.

Referring again to FIG. 8, the insulation bag 310 has a quadrilateral cross-sectional shape with at least one angled side 311 as viewed through plane A-A. In operation, one or more insulation bags 310 are positioned between adjacent framing members 306, with the angled side 311 seated against the roof deck 302 or seated against rafter ventilation channels 313, if existing. Optionally, the angled side 311 can be configured to form an angle that is consistent with an angle formed between the rafters 304 and the framing members 306.

While the embodiment of the insulation bag 310 shown in FIG. 8 has a quadrilateral cross-sectional shape with at least one angled side 311, it should be appreciated that in other embodiments, an insulation bag can have other cross-sectional shapes configured for application to insulation cavities having other shapes.

As discussed above, the general purpose insulation bag is configured to prevent or substantially retard the flow of air passing through openings or insulation cavities. The openings or insulation cavities can occur in various locations of a building. Non-limiting examples of openings include attic scuttles. Non-limiting examples of insulation cavities can include spaces adjacent rim joists and attic spaces at the intersections of rafters and framing members. The flexibility of the insulation bag advantageously permits ready positioning of the general purpose insulation bag over various openings and in various insulation cavities. The insulation bag advantageously also can be configured in different shapes and sizes, sufficient for application to specific insulation cavities.

The principle and mode of the general purpose insulation bag have been described in certain embodiments. However, it should be noted that the general purpose insulation bag may be practiced otherwise than as specifically illustrated and described without departing from its scope.

What is claimed is:

1. A general purpose insulation bag comprising:

a jacket configured to form a desired three dimensional shape, the jacket forming a cavity therewithin and having an opening, the opening covered by a covering structure, the jacket having an air permeability rating in a range of about 100 cubic feet per minute to about 140 cubic feet per minute, the jacket composed of a flexible material configured to maintain a partially-filled arrangement, wherein in the partially-filled arrangement, the jacket is filled with a volume of insulative material that is less than the jacket fully filled with insulative material and wherein in the partially-filled arrangement a height of the partially-filled jacket is less than a height of the fully filled jacket; and the insulative material positioned within the cavity and configured to form an insulative layer, the insulative layer having a thickness configured to provide a desired insulative value to the general purpose insulation bag;

wherein the opening is configured to retain the insulative material within the cavity formed within the jacket.

2. The general purpose insulation bag of claim 1, wherein the jacket forms an upper panel, a lower panel, opposing side panels and opposing end panels, and wherein the upper panel is connected to the opposing side panels and the opposing end panels by sewn seams and the lower panel is connected to the opposing side panels and the opposing end panels by sewn seams.

3. The general purpose insulation bag of claim 1, wherein the covering structure is a flap.

4. The general purpose insulation bag of claim 1, wherein the covering structure has a leading edge, and wherein the leading edge is positioned a distance from the opening in a range of from about 6.0 inches to about 10.0 inches.

5. The general purpose insulation bag of claim 1, wherein the jacket includes a plurality of perforations configured to allow air to flow through the jacket.

6. The general purpose insulation bag of claim 1, wherein the flexible material forming the jacket has a thickness resulting in a weight in a range of from about 2.0 ounces per square foot to about 3.0 ounces per square foot.

7. The general purpose insulation bag of claim 1, wherein the jacket is formed from a fibrous web of non-woven fibers.

8. The general purpose insulation bag of claim 1, wherein the bag has a length in a range of from about 30.0 inches to about 40.0 inches, a height in a range of from about 12.0 inches to about 18.0 inches and a depth in a range of from about 20.0 inches to about 28.0 inches.

9. The general purpose insulation bag of claim 1, wherein the bag provides an insulative value in a range of from about R-40 to about R-160.

10. The general purpose insulation bag of claim 1, wherein the bag is sized for insertion between framing members forming a building scuttle.

11. The general purpose insulation bag of claim 1, wherein the opening is a slit.

12. The general purpose insulation bag of claim 11, wherein the slit extends vertically a height of the bag.

13. The general purpose insulation bag of claim 1, wherein the insulative material within the bag is loosefill insulative material.

14. The general purpose insulation bag of claim 13, wherein the loosefill insulative material is binderless.

15. An insulated interior building cavity comprising:

an interior building cavity formed between framing members;

one or more general purpose insulation bags positioned in the interior building cavity and configured to insulate the interior building cavity, the one or more general purpose insulation bags comprising:

a jacket configured to form a desired three dimensional shape, the jacket forming a cavity therewithin and having an opening, the opening covered by a covering structure, the jacket having an air permeability rating in a range of about 100 cubic feet per minute to about 140 cubic feet per minute, the jacket composed of a flexible material configured to maintain a partially-filled arrangement, wherein in the partially-filled arrangement, the jacket is filled with a volume of insulative material that is less than the jacket fully filled with insulative material and wherein in the partially-filled arrangement a height of the partially-filled jacket is less than a height of the fully filled jacket; and the insulative material positioned within the cavity of the jacket and configured to form an insulative layer, the insulative layer having a thickness configured to provide a desired insulative value to the general purpose insulation bag;

wherein the opening is configured to retain the insulative material within the cavity formed within the jacket.

16. A method of insulating an interior building cavity, comprising the steps of:

positioning one or more general purpose insulation bags in the interior building cavity, the one or more general purpose insulation bags comprising:

a jacket configured to form a desired three dimensional shape, the jacket forming a cavity therewithin and having an opening, the opening covered by a covering structure, the jacket having an air permeability rating in a range of about 100 cubic feet per minute to about 140 cubic feet per minute, the jacket composed of a flexible material configured to maintain a partially-filled arrangement, wherein in the partially-filled arrangement, the jacket is filled with a volume of insulative material that is less than the jacket fully filled with insulative material and wherein in the partially-filled arrangement a height of the partially-filled jacket is less than a height of the fully filled jacket; and the insulative material positioned within the cavity of the jacket and configured to form an insulative layer, the insulative layer having a thickness configured to provide a desired insulative value to the general purpose insulation bag;

wherein the opening is configured to retain the insulative material within the cavity formed within the jacket.

* * * * *